US008387579B2

(12) United States Patent
Stolk et al.

(10) Patent No.: US 8,387,579 B2
(45) Date of Patent: Mar. 5, 2013

(54) VALVE DRIVE TRAIN ARRANGEMENT

(75) Inventors: Thomas Stolk, Kirchheim (DE); Alexander von Gaisberg-Helfenberg, Beilstein (DE); Jens Meintschel, Bernsdorf (DE)

(73) Assignee: Daimler AG, Stuttgart (DE)

( * ) Notice: Subject to any disclaimer, the term of this patent is extended or adjusted under 35 U.S.C. 154(b) by 254 days.

(21) Appl. No.: 12/804,289

(22) Filed: Jul. 19, 2010

(65) Prior Publication Data

US 2010/0288217 A1 Nov. 18, 2010

Related U.S. Application Data

(63) Continuation-in-part of application No. PCT/EP2008/001087, filed on Dec. 18, 2008.

(30) Foreign Application Priority Data

Jan. 23, 2008 (DE) ..... 10 2008 005 639

(51) Int. Cl.
*F01L 1/34* (2006.01)

(52) U.S. Cl. ..... 123/90.18; 123/90.6

(58) Field of Classification Search .... 123/90.15–90.18, 123/90.6

See application file for complete search history.

(56) References Cited

U.S. PATENT DOCUMENTS

| | | | | |
|---|---|---|---|---|
| 7,409,938 | B2 * | 8/2008 | Dengler | 123/90.18 |
| 2009/0064952 | A1 * | 3/2009 | Wutzler | 123/90.18 |

FOREIGN PATENT DOCUMENTS

| | | |
|---|---|---|
| DE | 44 19 637 | 12/1994 |
| DE | 195 19 048 | 11/1996 |
| DE | 197 02 389 | 7/1998 |
| DE | 102 41 920 | 3/2004 |
| JP | 59 183015 | 10/1984 |

* cited by examiner

*Primary Examiner* — Thomas E. Denion
*Assistant Examiner* — Daniel Bernstein
(74) *Attorney, Agent, or Firm* — Klaus J. Bach

(57) ABSTRACT

In a valve drive train arrangement for an internal combustion engine having a camshaft with a cam element axially displaceable supported on the camshaft and having a stop for limiting the axial movement of the cam element, the stop has at least one stop element extending radially from the camshaft for engagement with the cam element.

10 Claims, 4 Drawing Sheets

VALVE DRIVE TRAIN ARRANGEMENT

This is a Continuation-In-Part Application of pending international patent application PCT/EP2008/01087 filed Dec. 18, 2008 and claiming the priority of German patent application 10 2008 005 639.1 filed Jan. 23, 2008.

BACKGROUND OF THE INVENTION

The invention relates to a valve drive train arrangement for an internal combustion engine including a camshaft with an axially displaceable cam element and a stop for limiting the axial displacement of the cam element.

Valve drive train arrangements, in particular of internal combustion engines, including a camshaft with at least one cam element which is axially displaceable on the camshaft and with a stop device which is provided to limit the axial displacement of the cam element, have already been suggested.

It is the principal object of the present invention to provide a valve drive train arrangement with reduced inner friction force, whereby a more efficient operation of an internal combustion engine can be obtained.

SUMMARY OF THE INVENTION

In a valve drive train arrangement for an internal combustion engine having a camshaft with a cam element axially displaceable supported on the camshaft and having a stop for limiting the axial movement of the cam element, the stop includes at least one stop element extending radially from the camshaft for engagement with the cam element.

Preferably, the stop is connected to the camshaft in such a way that a relative rotation between the camshaft and the simultaneously rotating stop can be avoided. Inner friction forces of the valve train device can be reduced thereby, so that the efficiency of the internal combustion engine can be increased. The manufacturing costs are also reduced because fine-processing of stop surfaces at the cam elements and bearing bridges is not necessary. An installation of lubricating grooves can also be omitted. Expediently, the stops are arranged on the camshaft in an axially fixed manner and preferably also in a rotationally fixed manner, as for example by a form-fit connection between the stops and the camshaft.

It is further suggested that there is a stop structure, whereby the travel in the axial direction of the cam element can be restricted in both directions. In particular if the valve drive train arrangement has a second axially displaceable cam element, a stop structure for both cam elements can be provided in a simple manner by means of the two stops.

Expediently, the limitation of the path of the at least one cam element in at least one of the two axial directions takes place in an indirect manner via at least one further element and the stop device. The at least one further element is advantageously a cam element. For the limitation of the axial path of the cam element the cam element does not need to abut directly a stop surface of the stop device, but it may abut a further element, which is limited in its axial movement in an indirect manner and/or in a direct manner by the stop.

If the stop means is formed as an elevation over a camshaft base circle, a stop means of simple design which can easily be manufactured can be provided in an advantageous manner, so that the manufacturing costs are relatively low. A "camshaft base circle" is herein especially meant to be a circle which lies in a cross sectional area, especially in a cross sectional area in which the stop is disposed, and which extends normal to the rotational axis with the largest possible diameter that can be accommodated by the camshaft.

It is suggested in one arrangement of the invention that at least one stop structure of the stop is in the form of a bolt, whereby a manufacture can be very simple and cost-efficient. The second stop structure is preferably also in the form of a bolt. Alternatively to the stop member in the form of bolts, other stop means appearing to be suitable to the expert can also be used, as for example a stop ring which is fixed to the camshaft.

The camshaft preferably has a receiving structure, which is provided to accommodate at least the first stop member. The stop member can thereby be connected to the camshaft in a simple manner, whereby the friction force between the stop member and the stop surfaces can be avoided, as a relative rotation cannot take place any longer.

It is further suggested that the cam element has at least one stop surface, which is provided which is abutted intermittently by at least one stop member. Robust and reliable cost-efficient components which are commercially available can thereby be used.

It is particularly advantageous if the stop surface is formed at least partially as a face side of the cam element. Components which are already present for other reasons can thereby be used, so that axial installation space is saved. The term "face side" means a surface, which axially limits a component and which is arranged approximately vertically to a rotational axis of the camshaft. "Approximately" means that a deviation of up to a maximum of 20% is acceptable but a deviation of not more than 5% is preferable and a deviation of 0% is particularly advantageous. Preferably, only one of the two face surfaces is formed at least partially as a stop surface for the stop, while a second face surface is provided to produce a form-fit contact with the second cam element and thus to form especially a stop for the second cam element.

In a particularly advantageous embodiment of the invention, the cam element has a limitation surface forming a recess, which forms at least partially a stop surface. The axial installation space of the valve drive train arrangement can be reduced thereby.

The valve drive train arrangement preferably has a latching device, which is provided to exert an axial force on the cam element in at least one shift position. A certain position of the cam element can thereby be maintained in an advantageous manner and can be stabilized.

The latching device has advantageously latching recesses, which are formed as oblique grooves. An "oblique groove" is a latching recess which has at least one oblique surface in the axial direction. The oblique surface preferably includes an angle greater than zero and smaller than 90 degrees with regard to rotational axis, wherein the angle thereby converges especially on one side in the direction of the stop. A force acting radially on a spring-loaded latching ball can be deflected by means of the oblique groove, whereby the cam element can be pressed against the stop.

The invention will become more readily apparent from the following description of a particular embodiment thereof with reference to the accompanying drawings.

BRIEF DESCRIPTION OF THE DRAWINGS

It is shown in.

DESCRIPTION OF A PARTICULAR EMBODIMENT

Figure 1:
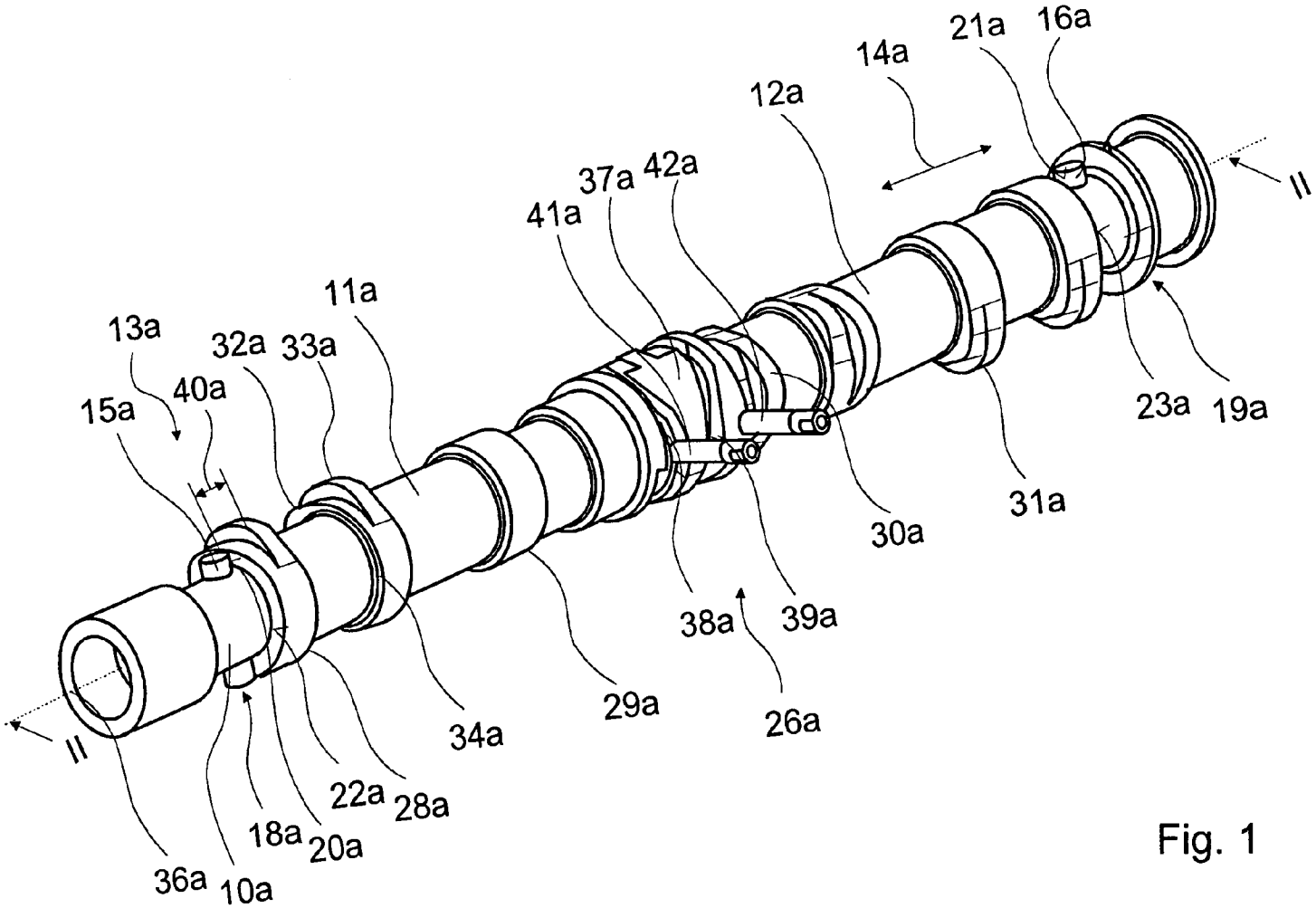
FIG. 1 a perspective view of a valve drive train arrangement with a camshaft, including axially displaceable cam elements and with a stop for limiting axial movement of the cam elements, FIG. 2 the valve drive train arrangement in a cross-sectional view taken along line II-II of FIG. 1, FIG. 3 the valve drive train arrangement in a cross-sectional view taken along line III-III of FIG. 2, FIG. 4 a perspective view of a valve drive train arrangement showing a second embodiment and FIG. 5 the valve drive train arrangement in a cross-sectional view taken along line V-V of FIG. 4.
Figure 2:
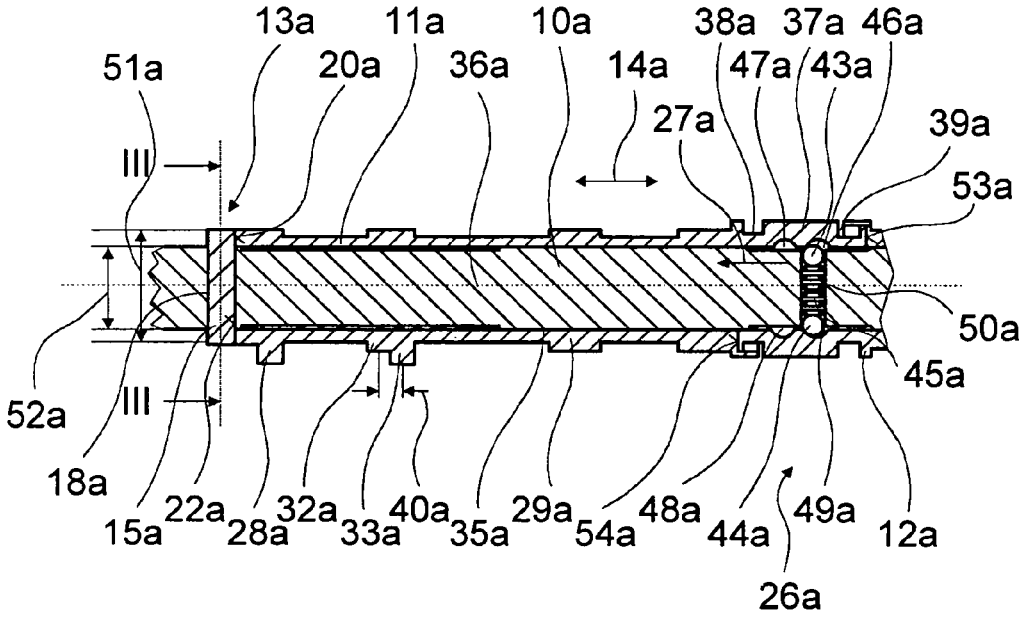
Figure 3:
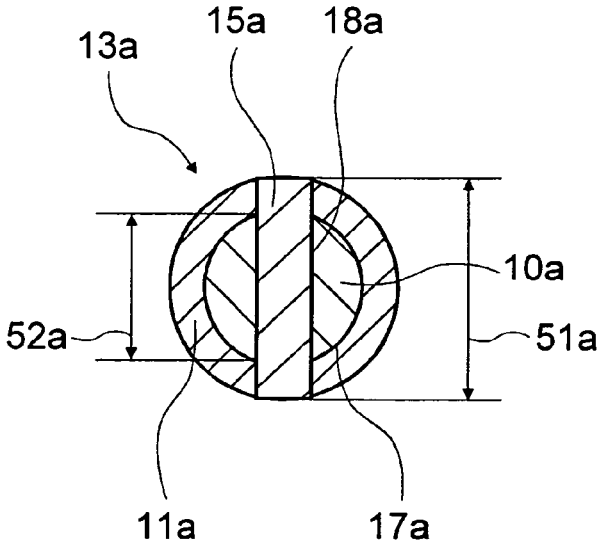

FIGS. 1, 2 and 3 show an arrangement of a valve drive train arrangement for an internal combustion engine according to the invention. The valve drive train arrangement has two cam elements 11*a*, 12*a* arranged on a camshaft 10*a* with respectively two cam pairs 28*a*, 29*a*, 30*a*, 31*a* for different cylinders. Each cam pair 28*a*, 29*a*, 30*a*, 31*a* has two differently designed cams 32*a*, 33*a* with the same base circle 34*a*, wherein the cams 32*a*, 33*a* are designed differently for different respective operating modes, as for example an engine firing mode and an engine braking mode or a low speed engine operating range and a high speed engine operating range.

Figure 4:
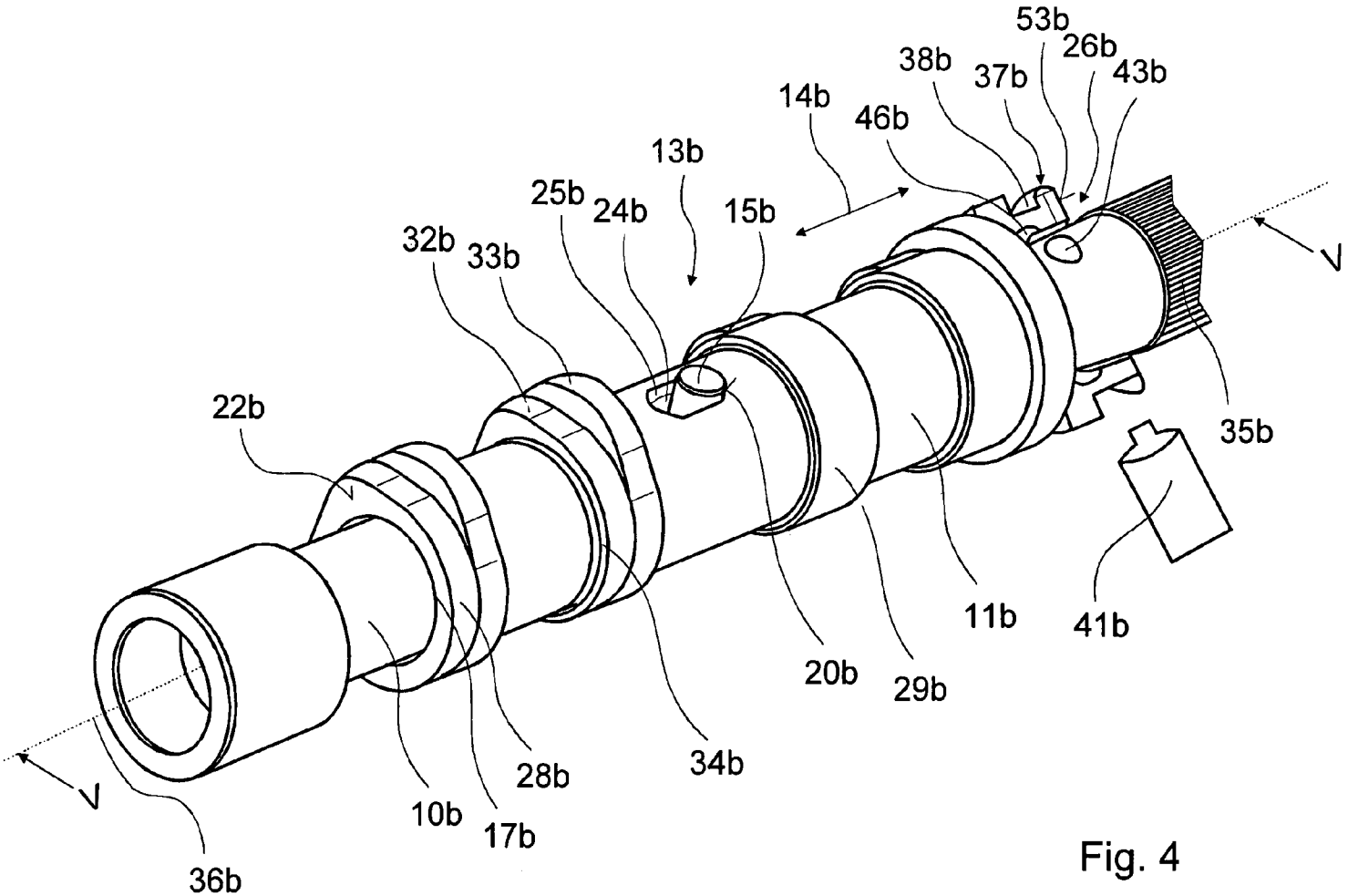

The two cam elements 11*a*, 12*a* are arranged on the camshaft 10*a* displaceably in the axial direction 14*a*. The camshaft 10*a* and the two cam elements 11*a*, 12*a* are connected in a rotationally fixed manner by means of a multiple tooth connection 35*a* (FIGS. 3, 4). In a first shifting position (see FIG. 1, 2) of the cam elements 11*a*, 12*a*, the respective first cams 32*a* of the cam pairs 28*a*, 29*a*, 30*a*, 31*a* are in contact with a cam follower, not shown in detail, whereby a corresponding charge-cycle valve, not shown in detail, is actuated by a rotation of the cam element 11*a*, 12*a* around a rotational axis 36*a*. In a second shifting position of the cam elements 11*a*, 12*a*, the respective second cams 33*a* of the cam pairs 28*a*, 29*a*, 30*a*, 31*a* are in contact with a further cam follower, not shown in detail, whereby the respective charge-cycle valve, not shown in detail, is then actuated by the rotation of the cam element 11*a*, 12*a* around the rotational axis 36*a*.

The valve drive train arrangement has an actuation device, by means of which the cam elements 11*a*, 12*a* can be displaced from a first shift position into a second shift position or vice versa. The displacement of the cam elements 11*a*, 12*a* in the axial direction 14*a* is defined by a shift path 40*a* of a shifting gate 37*a* with two gate paths 38*a*, 39*a*. In this embodiment, the shift path corresponds to a distance 40*a* between the centers of the two cams 32*a*, 33*a* of a cam pair 28*a*, 29*a*, 30*a*, 31*a*.

The actuation device comprises two actuation pins 41*a*, 42*a*, which can engage the gate paths 38*a*, 39*a* of the shift gate 37*a*, whereby the cam elements 11*a*, 12*a* can be displaced axially by the rotation of the camshaft 10*a*.

The valve drive train arrangement has a latching device 26*a*, by means of which the cam elements 11*a*, 12*a* are engaged in the respective shifting positions. Furthermore, an axial engagement force 27*a* is applied to the cam elements 11*a*, 12*a* by means of the latching device 26*a*. The latching device 26*a* has two latching balls 43*a*, 44*a*, a pressure spring 45*a* and latching recesses 46*a*, 47*a*, 48*a*, 49*a* on the inner sides of the two cam elements, which are formed as oblique grooves. The pressure spring 45*a* exerts a radially directed force on the latching balls 43*a*, 44*a*. By means of the latching recesses 46*a*, 47*a*, 48*a*, 49*a* formed as oblique grooves, which act according to a principle of the oblique plane, the axial force 27*a* is transferred to the cam elements 11*a*, 12*a*. Two latching recesses 46*a*, 47*a*, 48*a*, 49*a* are provided for each cam element 11*a*, 12*a*. The latching balls 43*a*, 44*a* are arranged in the camshaft 10*a* in a recess 50*a*, in the form of a bore extending radially through the camshaft 10*a*.

The valve train device has a stop 13*a* with two stop means 15*a*, 16*a* and stop surfaces 20*a*, 21*a*, by means of which the displacement of the cam elements 11*a*, 12*a* in the axial direction 14*a* is limited. The stop means 15*a*, 16*a*, which extend over a camshaft base circle 17*a*, are in the form of bolts. Two accommodating structures 18*a*, 19*a* receive the stop means 15*a*, 16*a* which are in the form of bolts. The accommodating structure 18*a*, 19*a* are radial through bores in the camshaft. The length 51*a* of the bolts (15*a*, 16*a*), is larger than a diameter 52*a* of the camshaft 10*a*, so that the lengths of the bolt formed projecting over the camshaft base circle 17*a* have approximately the same size and are arranged diametrically opposite each other (see FIG. 3). Face sides 22*a*, 23*a* of the two cam elements lying axially outside with regard to the shift gate 37*a* partially form two stop surfaces 20*a*, 21*a* of the altogether four stop surfaces 20*a*, 21*a*, 53*a*, 54*a*. The further stop surfaces 53*a*, 54*a* lying axially inside with regard to the shift gate 37*a* are arranged between the cam elements 11*a*, 12*a*, wherein the one stop surface 53*a* is associated with the first cam element 11*a* and the other stop surface 54*a* is associated with the second cam element 12*a*. The stop surfaces 53*a*, 54*a* are formed in a complementary manner.

By the displacement of the cam element 11*a*, 12*a*, a radial force is exerted on the latching balls 43*a*, 44*a*, by means of which the latching balls are first pressed radially inwardly. By means of the radially outwardly acting reset force of the pressure spring 45*a*, the latching balls 43*a*, 44*a* latch into the adjacent latching recess 46*a*, 47*a*, 48*a*, 49*a* after the displacement. The first cam element 11*a* is pressed against the bolt forming as the first stop means 15*a* in the first shifting position via the first latching recess 46*a* of the first cam element 11*a* by means of the spring-loaded first latching ball 43*a*. The second cam element 12*a* is pressed against the first cam element 11*a* via the second latching recess 49*a* of the second cam element 12*a* by means of the spring-loaded second latching ball 44*a*.

The displacement of the cam elements 11*a*, 12*a*, which is carried out by means of the shift gate 37*a*, shifts the cam elements from the first into the second shift position. Starting from the first shift position, the second cam element 12*a* is displaced first. During the displacement of the second cam element 12*a*, the second latching ball 44*a* is pressed out of the second latching recess 49*a* and latches into the first latching recess 48*a* after the displacement.

The second cam element 12*a* is now in the second shift position and is held between the second stop means 16*a* and the latching ball 44*a* by means of the axial force 27*a*, which the latching device 26*a* exerts on the cam element 12*a* in the direction of the second stop means 16*a*.

After the displacement of the second cam element 12*a*, the displacement of the first cam element 11*a* again takes place by means of the shifting gate 37*a*. The first latching ball 43*a* is thereby pushed out of the first latching recess 46*a* of the first cam element 11*a* and subsequently engages into the second latching recess 47*a*. The first cam element 11*a* is now clamped between the first latching ball 43*a* and the second cam element 12*a* by the axial force 27*a*, which the latching device 26*a* exerts on the cam element 11*a* in the direction of the second stop means 16*a*. After their displacement, both cam elements 11*a*, 12*a* are again in the first shift position.

During the change-over from the second into the first shift position, the first latching ball 43*a* of the first cam element 11*a* is pushed out of the second latching recess 47*a* via the actuation device analogously to the change-over from the first to the second shift position, and engages into the first latching recess 46*a*. The first cam element 11*a* is then in the first shifting position and is clamped between the first stop means 15*a* and the first latching ball 43*a* by means of the axial force 27*a* of the latching device 26*a*. The displacement of the second cam element 12*a* takes place subsequently, whereby the second latching ball 44*a* is pushed out of the first latching recess 48*a* of the second cam element 12*a* and engages into the second latching recess 49*a*. The second cam element 12*a* is now clamped between the second latching ball 44*a* and the first cam element 11*a* by the axial force 27*a* of the latching device 26*a*. Both cam elements 11*a*, 12*a* are again in the first shift position after this displacement.

Figure 5:
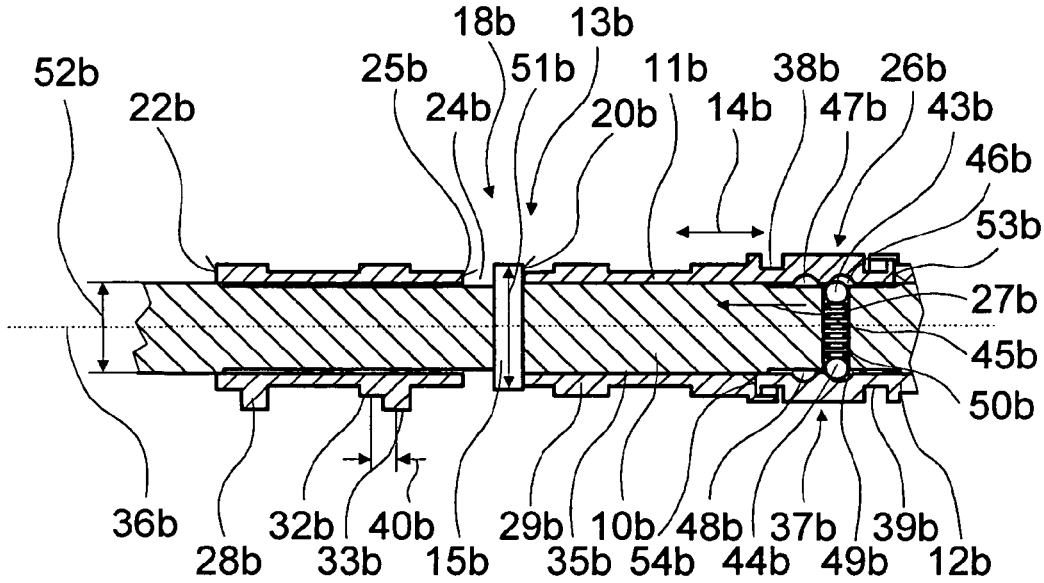

FIGS. 4 and 5 show an alternative arrangement of a valve drive train arrangement with a stop 13*b*. For distinguishing the embodiments, the letter a is replaced in the reference numerals of the embodiment in FIGS. 1,2 and 3 by the letter b in the reference numerals of the embodiments in FIGS. 4 and 5. The following description is essentially restricted to the differences between the embodiment in FIGS. 1, 2 and 3, wherein one can refer to the description in FIGS. 1, 2 and 3 with regard to the same components, characteristics and functions.

FIG. 4 shows a first cam element 11*b*, which is arranged in a displaceable manner on a camshaft 10*b* in the axial direction 14*b*. The camshaft 10*b* has a stop means 15*b*, which is designed by means of a bolt. The stop means 15*b* has two elevations above a camshaft base circle 17*b* and is arranged axially between the face side 22*b* and a stop surface 53*b* of a first cam element 11.

The stop 15*b* is disposed in a recess 24*b* in the cam element 11*b*. A limitation surface 25*b* formed by the recess 24*b* has a stop surface 20*b*, which limits a path in the axial direction 14*b* of the cam element 11*b*. The stop surface 20*b* is on a partial surface of the limitation surface 25*b* of the recess 24*b* lying in the direction of a shifting gate 37*b*. Generally, a second partial surface axially opposite the first partial surface can also be formed as a further stop surface.

By means of the stop surface 20*b* on the limitation surface 25*b* of the recess 24*b*, the path is limited in the axial direction 14*b* of the cam element 11*b*. A dimension of the recess 24*b* in the axial direction 14*b* is thereby larger than a dimension of the stop means 15*b*, wherein an axial displacement of the first cam element 11*b* from a first shifting position into a second shifting position and vice versa is made possible. In the first shifting position, the cam element 11*b* is clamped between the stop surface 20*b* on the limiting surface 25*b* and a latching ball 43*b*. The second cam element 12*b* is analogously clamped in the second shifting position.

The second cam element is designed in an equivalent manner. A description and a representation of the second cam element 12*b* is therefore foregone here.

What is claimed is:

1. A valve drive train arrangement, of an internal combustion engine, comprising: a camshaft (10*a*; 10*b*), having at least one cam element (11*a*, 12*a*; 11*b*, 12*b*) axially displaceable disposed on the camshaft (10*a*; 10*b*), and a stop device (13*a*; 13*b*) disposed on the camshaft for limiting a path of axial movement (14*a*; 14*b*) of the cam element (11*a*, 12*a*; 11*b*, 12*b*) along the camshaft, said stop device (13*a*, 13*b*) having at least a first stop element (15*a*, 16*a*; 15*b*) which is connected to the camshaft (10*a*; 10*b*), the at least first stop element (15*a*, 16*a*; 15*b*) of the stop device (13*a*; 13*b*) being in the form of a bolt projecting radially from the camshaft.

2. The valve drive train arrangement according claim 1, wherein the stop device (13*a*; 13*b*) has a second stop element (16*a*).

3. The valve train device according to claim 1, wherein the limit of the axial path of movement of the cam element (11*a*, 12*a*; 11*b*, 12*b*) is established in an indirect manner by the stop device (13*a*, 13*b*) and at least one additional element.

4. The valve drive device train arrangement according to claim 3, wherein the at least one additional element is a cam element (11*b*, 12*b*; 11*a*, 12*a*).

5. The valve drive train arrangement according to claim 3, wherein the cam element (11*a*, 12*a*; 11*b*, 12*b*) has at least one stop surface (20*a*, 21*a*; 20*b*), for abutment by at least one of the stop elements (15*a*, 16*a*; 15*b*) and periodically the additionally element.

6. The valve drive train arrangement according to claim 5, wherein the stop surface (20*a*, 21*a*) is at least partially formed by a face side (22*a*, 23*a*) of the cam element (11*a*, 12*a*).

7. The valve drive train arrangement according to claim 5, wherein the cam element (11*b*) has a limitation surface (25*b*) formed by a recess (24*b*), which surface forms at least partially, a stop surface (20*b*).

8. The valve drive train arrangement according to claim 1, wherein the stop element (15*a*16*a*, 15*b*) is in the form of an elevation over a camshaft base circle (17*a*; 17*b*).

9. The valve drive train arrangement according to claim 1, wherein the camshaft (10*a*; 10*b*) has at least one receiving structure (18*a*, 19*a*; 18*b*, 19*b*), for receiving at least the first stop element (15*a*, 16*a*, 15*b*).

10. The valve drive train arrangement device according to claim 1, wherein the valve drive train arrangement includes a latching structure (26*a*, 26*b*), providing an axial force (27*a*; 27*b*) on the cam element (11*a*; 11*b*) in at least one shift position.

* * * * *